United States Patent [19]

Noro

[11] 4,366,432

[45] Dec. 28, 1982

[54] HIGHLY STABLE CONSTANT-VOLTAGE POWER SOURCE DEVICE

[75] Inventor: Masao Noro, Asaka, Japan

[73] Assignee: Stax Industries Limited, Tokyo, Japan

[21] Appl. No.: 248,159

[22] Filed: Mar. 30, 1981

Related U.S. Application Data

[63] Continuation of Ser. No. 67,509, Aug. 17, 1979, abandoned.

[30] Foreign Application Priority Data

Aug. 18, 1978 [JP] Japan ..... 53-100774

[51] Int. Cl.[3] ..... G05F 1/64

[52] U.S. Cl. ..... 323/224; 323/225; 323/226; 330/297

[58] Field of Search ..... 323/244–226, 323/269; 330/297

[56] References Cited

U.S. PATENT DOCUMENTS 3,124,698 3/1964 Semmer et al. ..... 323/224
3,524,124 8/1970 Perkinson .
3,566,246 2/1971 Seer .
3,771,043 11/1973 Zulaski ..... 323/226
3,886,436 5/1975 Wadlington .
3,939,399 2/1976 Fanatsu et al. .

FOREIGN PATENT DOCUMENTS 52-6550 9/1977 Japan ..... 330/297

OTHER PUBLICATIONS

EDN, vol. 20, pp. 76–77, Mar. 20, 1975.
Wireless World, vol. 82, p. 90. Mar. 1976.
Rev. Sci. Instum. 49(10), pp. 1401, 2, Oct. 1978.

*Primary Examiner*—William H. Beha, Jr.
*Attorney, Agent, or Firm*—Sughrue, Mion, Zinn, Macpeak and Seas

[57] ABSTRACT

A constant-voltage power source device for a highly accurate electric circuit, connected to an A.C. power source, capable of minimizing size of the current loop, making the ground line current constant even when the load current varies, and having a high noise elimination ratio as well as a low output impedance.

The device comprises a constant-current circuit connected in series with the load, and in parallel therewith a constant-voltage circuit including a control amplifier which controls the current flowing therethrough so that sum of this current and the output current of the device supplied to the load equals to the output current of the constant-current circuit.

6 Claims, 10 Drawing Figures

HIGHLY STABLE CONSTANT-VOLTAGE POWER SOURCE DEVICE

This is a continuation, of application Ser. No. 67,509 filed Aug. 17, 1979 abandoned.

BACKGROUND OF THE INVENTION

The present invention relates to a power source device in an electric circuit such as an audio/video recording and/or reproducing apparatus or a measuring instrument for which an especially high level of accuracy is required.

In order to mitigate the adverse influences of noise or ripple from an A.C. power source, in electric circuits for an audio/video equipment or a measuring instrument, etc. for which an extremely high level of accuracy is required, it is theoretically possible to drive a load at a constant voltage such as an amplifier, for example, by means of batteries which may be regarded as one of the ideal power sources. Though extremely specific and rare, this method is actually practised by enthusiastic users of ultra-high grade audio amplifiers.

Specifically, it is possible to make extremely small a current loop, indicated by the broken line in FIG. 1, by connecting batteries 2, which are independent of the A.C. power source and hence, perfectly free in principle from noise and ripple, close to the load 4 formed, for example, by an amplifier 4A and the load circuit 4B to be driven thereby. Even when a current flows through the load, no current flows through the ground line 6 connected to an earth terminal E so that it can be kept at a constant potential.

If 12 V car batteries, for example, are to be used as a power source, four such batteries will be necessary for one channel and hence, eight for stereo use. This is extremely disadvantageous from the aspect of installation space. Needless to say, such a battery power source cannot be incorporated in an ordinary equipment.

In order to realize a power source device which uses a commercial A.C. power as its input and yet provides excellent constant-voltage characteristics equivalent to a battery, the following conditions must generally be satisfied:

(1) The power source device should be capable of minimizing the size of the current loop.

(2) When a current flowing through the ground line is influenced by a change in the load current or the like, the ground potential fluctuates correspondingly. Hence, the power source device should be capable of making the current flowing through the ground line zero or constant.

(3) The power source device should have an extremely high power source noise elimination ratio in order to be free from the influence of the A.C. power source.

(4) As the basic performance of the power source, it should have a low output impedance.

As a power source device satisfying these conditions to some extent, there has conventionally been put into practical use a series type constant-voltage power source device. Namely, as shown in FIGS. 2 and 3, a current flowing in the series type constant-voltage circuit 8 is equal to a current flowing through the load 4, and the intensity of a current flowing through the current loop is the same at any position of the loop. The output current $I_o$ has a value as required by the load and generally involves considerable fluctuation. When the output current $I_o$ changes in the series type constant-voltage power source device, a change in current occurs not only in the constant-voltage circuits but also in all the other component parts forming the power source, ranging from a power transformer 10, a rectifier 12, a smoothing capacitor 14 to a wire material connecting the power source and the ground line 6 extending from the rectifier 10 to the load 4. These component parts, the wire material and the ground line 6 which together form the power source have, in general, complicated impedance characteristics. Accordingly, a complicated and detrimental voltage is produced across both terminals $V_o$, $E_o$ of the power source device along with the abovementioned change in the current. This voltage exerts an adverse influence also on the constant-voltage circuit so that the potential of the ground line 6, which should be constant originally, causes fluctuation in response to the load current. For this reason, the known series type constant-voltage power source device does not perfectly satisfy all the abovementioned requirements and is obviously inferior to a battery power source when applied to a measuring instrument or to an audio equipment for which a high level of accuracy is required.

SUMMARY OF THE INVENTION

The object of the present invention is therefore to provide a constant-voltage power source device which altogether satisfies the aforementioned requirements, has ideal characteristics in the same way as the battery power source and yet can be constructed to be of compact size.

In order to accomplish this object, the constant-voltage power source device according to the present invention includes a constant-current circuit connected in series with the load, and in parallel therewith a constant-voltage circuit. The constant voltage circuit is provided with a control amplifier which controls the current flowing therethrough so that the sum of this current and the output current of the device supplied to the load equals to the output current of the constant-current circuit. In this manner, even when the device is supplied with astable voltage derived from the A.C. power source, the device is capable of supplying a stabilized output voltage to the load.

BRIEF DESCRIPTION OF THE DRAWINGS

The present invention will now be explained more in detail by referring to the preferred embodiments shown in the drawings, in which.

DETAILED DESCRIPTION OF THE PREFERRED EMBODIMENTS

Figure 4:
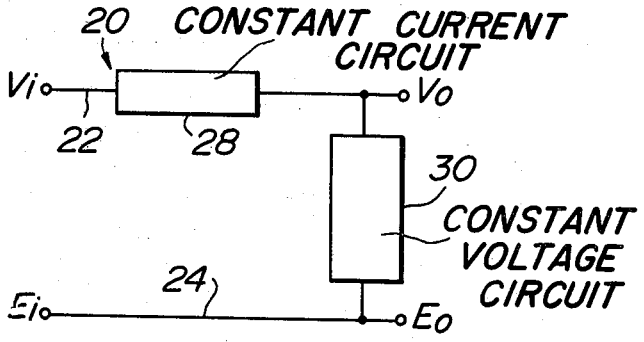
FIG. 4 is a block diagram showing the construction in principle of the constant-voltage power source device in accordance with the present invention.

Referring now to FIG. 4, there is shown the basic construction of the constant-voltage power source device in accordance with the present invention. This constant-voltage power source device 20 comprises a power supply line 22 and a ground line 24 which are interposed between a pair of input terminals $V_i$, $E_i$ for applying an astable input voltage and a pair of stabilized output terminals $V_o$, $E_o$ which, in turn, are connected to a load circuit 26, FIG. 5, to be driven at a constant voltage. The constant-voltage power source device according to the present invention comprises a constant-current circuit 28 and a constant-voltage circuit 30 whereby the constant-current circuit 28 is interposed in the power supply line 22 while the constant-voltage circuit 30 is interposed between the power supply line 22 on the output side of the constant-current circuit 28 and the ground line 24 so that the constant voltage circuit 30 becomes parallel to the load circuit 26.

Figure 5:
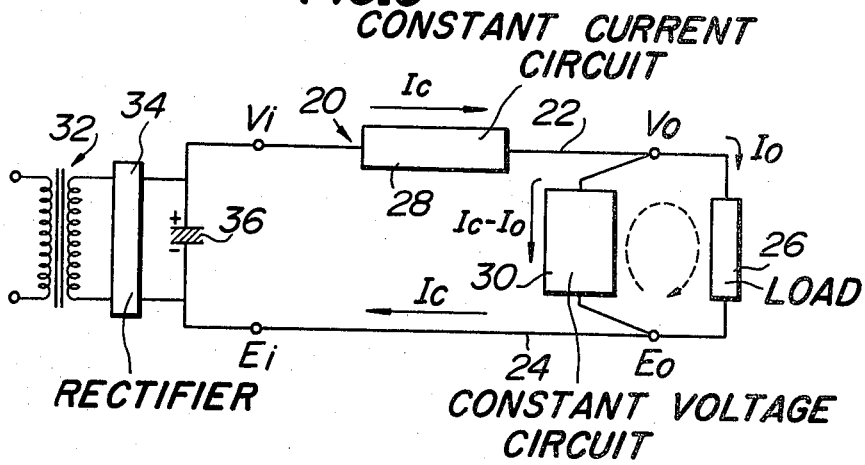
FIG. 5 is a block diagram showing one embodiment of the present invention.

FIG. 5 illustrates the constant-voltage source 20 shown in FIG. 4 as being connected at its input terminals $V_i$, $E_i$ to an input circuit comprising a power transformer 32 to which an A.C. current is supplied, a rectifier 34 and a smoothing capacitor 36, and at its output terminals $V_o$, $E_o$ to the load circuit 26. A current $I_c$, which is allowed to flow through the constant-current circuit 28, is set to be greater than or equal to the maximum current $I_o$ which is necessary for driving the load 26, so that a current $I_c$–$I_o$ flows through the constant-voltage circuit 30. When the load current $I_o$ changes, the constant-voltage circuit 30 imparts reverse change to the current flowing through the constant-voltage circuit per se and thus maintains a constant voltage across the output terminals $V_o$, $E_o$. By the provision of the constant-current circuit 28, the abovementioned input circuit formed by the power transformer 32, the rectifier 34 and the smoothing capacitor 36 supplies a predetermined current only, and this current $I_c$ exhibits a constant value irrespective of the change in the load current $I_o$. Accordingly, a current flowing through the wire material and the ground line also becomes constant at all times. A current loop shown by the broken line, whose current varies in accordance with the change in current of the load, consists only of the load 26, the parallel type constant-voltage circuit 30 and the wire material for connecting these circuits. By placing the constant-voltage circuit 30 adjacent to the load 26, it is possible to make the current loop extremely small. In this case, since a constant current always flows through the ground line 24 from the constant-voltage circuit to the rectifier and through the wire material for supplying the current, the potential of the ground line 24 is always kept constant even when a current flowing through the load 26 changes.

Figure 6:
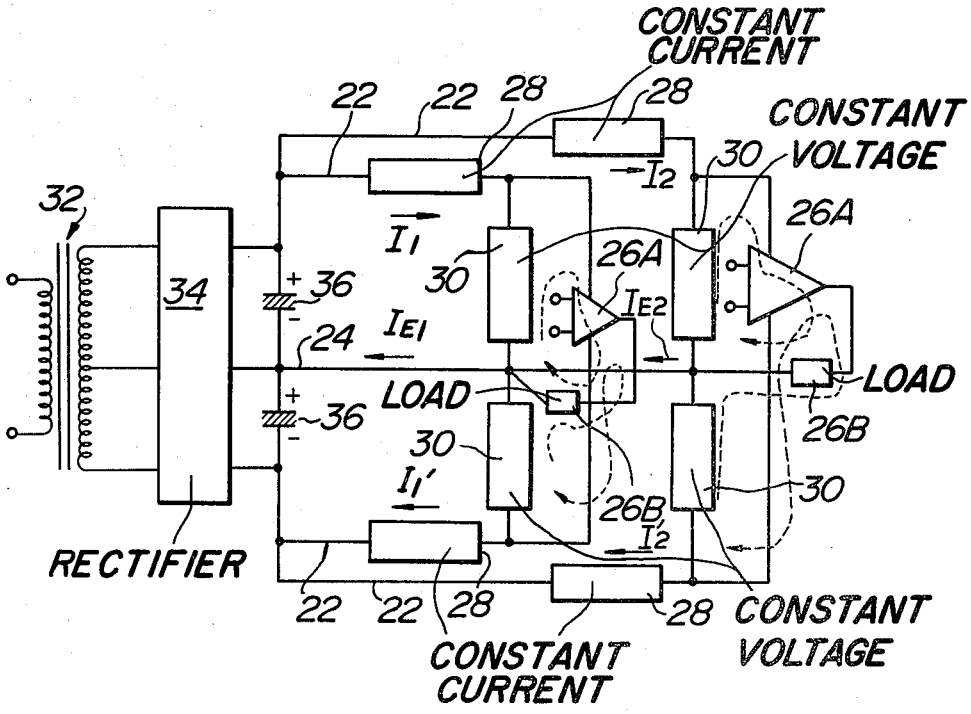
FIG. 6 is a block diagram showing another embodiment of the present invention.

This also applies to the case where a plurality of parallel type constant-voltage circuits, each combined with a constant-current circuit, are provided as shown in FIG. 6. In other words, in accordance with the present invention, a constant current always flows through the ground line 24 even if the same or different current changes take place in the respective loads 26A, 26B; hence, the potential of the ground line exhibits no change. In the case of a positive-negative two-power source type device, it is possible to always make zero those ground line currents $I_{E1}$ and $I_{E2}$ by mutually equalizing the set currents $I_1$, $I'_1$ and $I_2$, $I'_2$ of the constant-current circuits forming respective pairs on the positive side and on the negative side.

In other words, if $I_1$ is made equal to $I'_1$ and $I_2$ to $I'_2$ ($I_1=I'_1$ and $I_2=I'_2$), each of the ground line current can be expressed as follows:

$$I_{E1}=I_1-I'_1+I_2-I'_2=0$$

$$I_{E2}=I_2-I'_2=0$$

This shows that the potential is equal at any position of the ground line.

A detailed explanation will now be made, with reference to FIG. 7, to the constant-current circuit and the constant-voltage circuit in the constant-voltage power source device of the present invention.

The constant-current circuit 28 comprises a FET $Q_1$, transistors $Q_2$, $Q_3$, diodes $Z_1$, $Z_2$, $Z_3$ and resistors $R_1$, $R_2$. In the FET $Q_1$, the gate and the source are used as a common terminal to thereby supply the diodes $Z_1$, $Z_2$ and $Z_3$ with a constant current. By the constant current from the FET $Q_1$, each of the diodes $Z_1$, $Z_2$, $Z_3$ produces a junction voltage across the respective ends so that a voltage equal to the sum of these junction voltages is produced across both ends of the series circuit of the diodes $Z_1$, $Z_2$ and $Z_3$. The transistors $Q_2$ and $Q_3$ are connected with each other so that a negative feed-back is applied from the collector of the transistor $Q_3$ to the emitter of the transistor $Q_2$. By this reason, the circuit 28 operates in such a manner that a constant voltage is produced across both ends of the resistor $R_1$, said constant voltage being the balance obtained by deducting the junction voltage of the transistor $Q_2$ from the sum of the junction voltages of the diodes $Z_1$, $Z_2$ and $Z_3$. Hence, a constant current flows through the resistor $R_1$. In addition, since a current flowing through the FET $Q_1$ is also constant, this circuit 28 functions as a constant-current circuit whose output current becomes always constant irrespective of the voltage impressed across its both terminals.

Where the current flowing through the constant-current circuit is set to be of considerably large value, the heat radiation quantity of the transistor $Q_3$ increases so that a large transistor must sometimes be used as the transistor $Q_3$. Since the junction capacity of the transistor $Q_3$ also increases in such a case, the constant-current characteristic tends to become deteriorated in the high frequency range. However, even if the transistor $Q_3$ is of a large type, it is still possible to obtain good constant-current characteristics also in the high frequency range by connecting the transistors $Q_2$ and $Q_3$ in the abovementioned manner and by using a transistor having a small junction capacity as the transistor $Q_2$.

The constant-voltage circuit comprises a FET $Q_4$, transistors $Q_5$, $Q_6$, $Q_7$, $Q_8$, $Q_9$, $Q_{10}$, resistors $R_3$, $R_4$, $R_5$, $R_6$, $R_7$, $R_8$, $R_9$ and capacitors $C_1$, $C_2$, $C_3$. In order to avoid thermal drift of the circuit, the operating point of the FET $Q_4$ is set at a Q point where the thermal coefficient of the drain current of the FET $Q_4$ becomes zero. This is achieved by selecting a FET having a suitable $I_{DSS}$, or characteristic of the drain current to the voltage between the gate and the source. The gate and the source of the FET $Q_4$ are mutually connected so as to supply a constant current to the resistor $R_3$. Hence, a constant voltage is produced across both ends of the resistor $R_3$. The capacitor $C_1$ is connected in parallel with the resistor $R_3$ in order to improve the constant-voltage characteristics in the high frequency range. The FET $Q_4$, the resistor $R_3$ and the capacitor $C_1$ together form a reference voltage circuit 38.

The voltage produced across both ends of the parallel circuit of the capacitor $C_1$ and the resistor $R_3$ is applied to one input of an error amplifier 40, namely to the base of the transistor $Q_5$ which, together with the transistor $Q_6$ forms a differential amplifier. A voltage obtained by dividing the voltage across both terminals of the constant-voltage circuit 30 by means of a voltage detecting circuit 42 formed by the resistors $R_7$, $R_8$ and the capacitor $C_2$ is applied to the other input of the error amplifier 40, namely to the base of the transistor $Q_6$.

The output of the transistor $Q_5$, $Q_6$ is fed to a current mirror circuit consisting of the transistors $Q_7$, $Q_8$ and the resistors $R_5$, $R_6$. The output combined by the current mirror circuit is in turn impressed onto the base of the transistor $Q_9$ which is wired to the transistor $Q_{10}$ to form a Darlington-connected control amplifier 44. The differential amplifier $Q_5$, $Q_6$ compares the voltage across both ends of the parallel circuit of the resistor $R_3$ and the capacitor $C_1$ with the voltage across both ends of the resistor $R_7$. When the voltage across both ends of the resistor $R_7$ changes, the output of the differential amplifier changes so as to change the current of the transistors $Q_9$, $Q_{10}$ through the current mirror circuit and to make the voltage across both ends of the resistor $R_7$ equal to the voltage across both ends of the parallel circuit of the resistor $R_3$ and the capacitor $C_1$. Since the voltage across both ends of the resistor $R_7$ is a dividend of the voltage across both ends of the constant-voltage circuit, this circuit functions as the constant-voltage circuit, this circuit functions as the constant voltage circuit. Incidentally, the capacitor $C_2$ is used for improving the constant-voltage characteristics in the high frequency range and the capacitor $C_3$ is used for stabilizing the action of the constant-voltage circuit.

Figure 7:
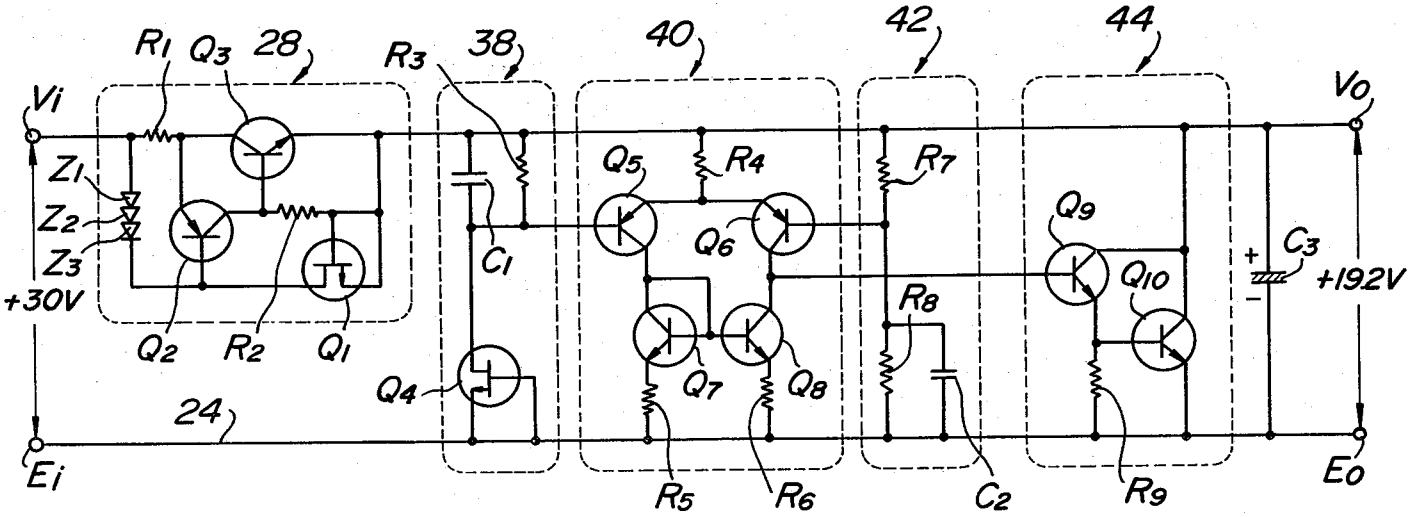
FIG. 7 is a circuit diagram showing one example of the constant-current circuit and the constant-voltage circuit in accordance with the present invention.

Particulars of each of the elements shown in FIG. 7 is as follows:

| | |
|---|---|
| FETs $Q_1$, $Q_4$ | NEC 2SK 68A ($I_{DSS}$ 4 mA) |
| Transistors $Q_2$, $Q_5$, $Q_6$ | Hitachi 2SA 872A |
| Transistor $Q_3$ | Toshiba 2SC 1624 |
| Transistors $Q_7$, $Q_8$, $Q_9$ | Hitachi 2SC 1775A |
| Transistor $Q_{10}$ | Hitachi 2SD 736A |
| Diodes $Z_1$, $Z_2$, $Z_3$ | Toshiba IS 1553 |
| Resistor $R_1$ | 6.8 Ω |
| Resistors $R_2$, $R_9$ | 680 Ω |
| Resistor $R_3$ | 2.4 kΩ |
| Resistor $R_4$ | 6.8 kΩ |
| Resistors $R_5$, $R_6$ | 100 Ω |
| Resistors $R_7$, $R_8$ | 10 kΩ |
| Capacitors $C_1$, $C_2$ | 1 μF |
| Capacitor $C_3$ | 10 μF |

Figure 1:
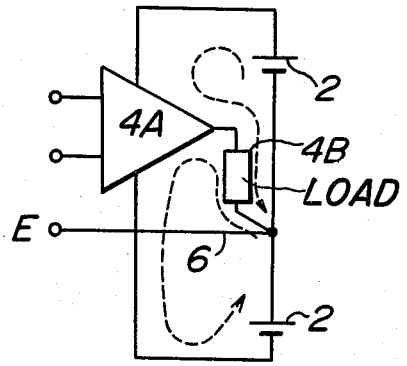
FIG. 1 PRIOR ART
FIG. 1 is a block diagram useful for explaining the action of the battery power source.
Figure 2:
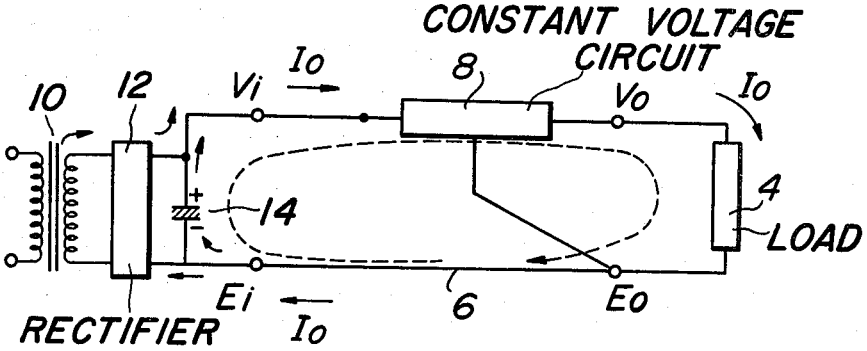
FIG. 2 PRIOR ART
FIG. 2 is a block diagram of the conventional series type constant-voltage power source device.
Figure 3:
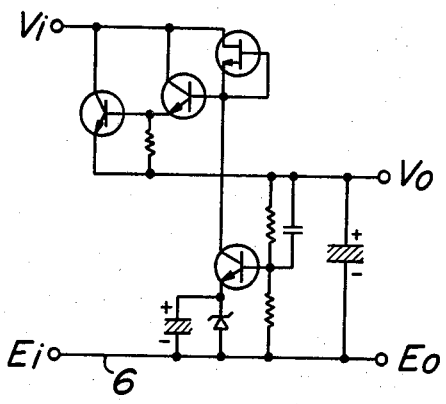
FIG.3 PRIOR ART
FIG. 3 is a circuit diagram of one example of the constant-voltage circuit of the device shown in FIG. 2.
Figure 8:
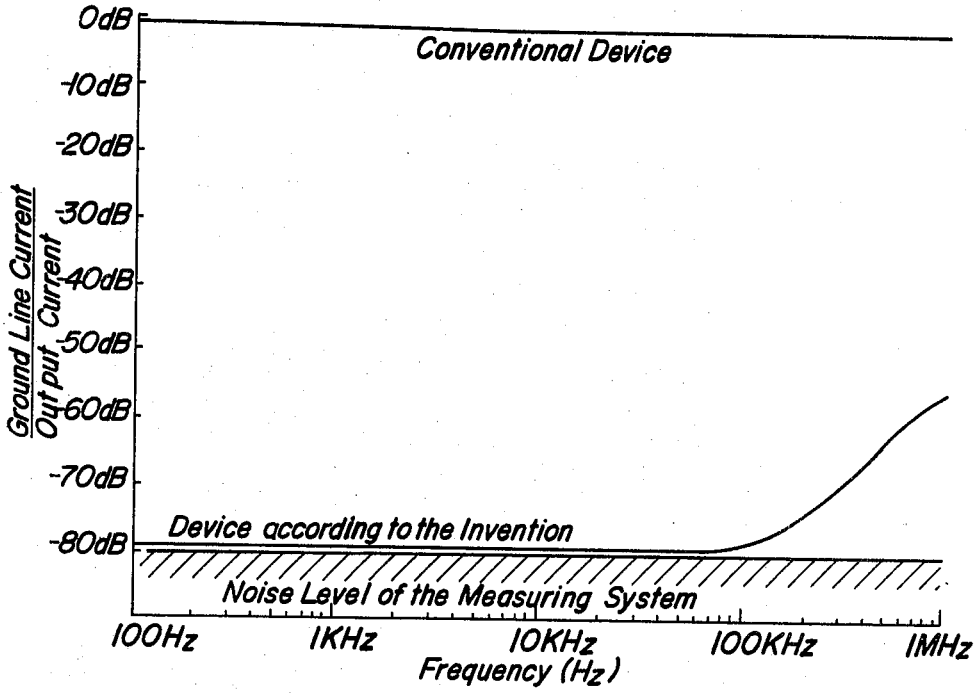
FIG. 8 is a diagram showing ratio of the ground line current to the output current according to the device of the present invention.

FIG. 8 is a diagram which shows the ratio of the change in the output current of the constant-voltage power source device according to the present invention, to the change in the ground line current. In the conventional series type constant-voltage power source device shown in FIGS. 2 and 3, this ratio is substantially 1. It can be appreciated that in accordance with the present invention, the change in the ground line current is reduced by about −78 dB even in the high frequency range of 100 kHz, and down to still lower levels in the lower frequency range.

Figure 9:
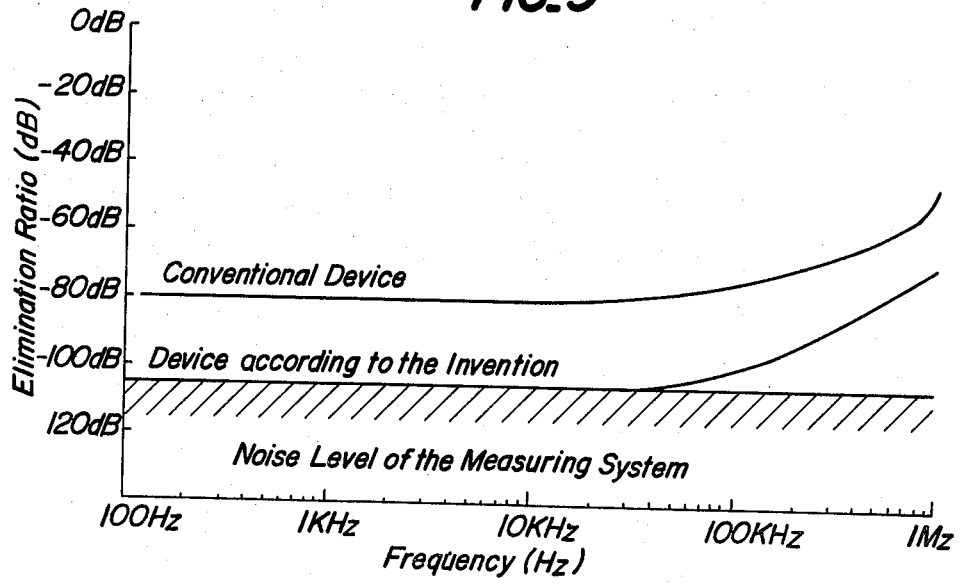
FIG. 9 is a diagram showing the power source noise elimination ratio in the device of the present invention.

FIG. 9 is a diagram showing how much noise contained in the astable input voltage is eliminated therefrom to generate the stabilized output voltage. In the constant-voltage power source device of the present invention, the noise is eliminated by about −100 dB in the high frequency range of about 100 kHz and a still better noise elimination ratio can be obtained in the frequency range lower than 100 kHz. It can be seen that the value is by at least 20 dB more excellent than the value obtained by the conventional series type constant-voltage power source device of FIGS. 2 and 3. The superiority of the constant-voltage power source device according to the present invention over the conventional series type constant-voltage power source device in this characteristic is due to the synergistic effect obtained by the combination of the constant-current circuit 28 with the constant-voltage circuit 30.

Figure 10:
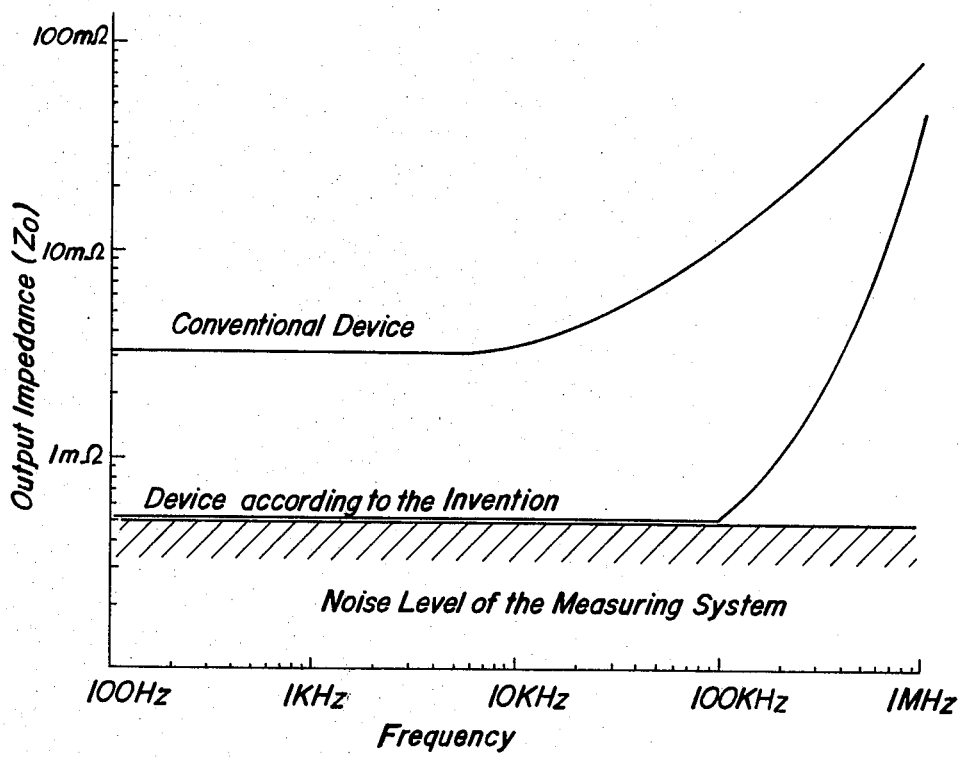
FIG. 10 is a diagram showing the output impedance characteristics of the device of the present invention.

FIG. 10 is a diagram showing the output impedance characteristic obtained by the arrangement of FIG. 7 between the point on the power supply line forming the junction of the capacitor $C_1$ and the resistor $R_3$, and the point on the ground line forming the junction of the capacitor $C_2$ and the resistor $R_8$. It has to be noted, however, that inappropriate selection of those points sometimes results in deterioration of this characteristics as even a short wire material often exhibits an impedance which cannot readily be compensated for. As can be appreciated from this diagram, the constant-voltage power source device in accordance with the present invention is capable of supplying a stable output voltage at a low impedance even in the high frequency range of the load current. This is due to the fact that since the constant-voltage circuit 30 in the device of the present invention functions so as to stabilize the voltage across both ends of its own, the control circuit is kept at a constant voltage and thus enables a great deal of negative feed-back to be applied in a stable manner. In contrast to this, in the conventional series type constant-voltage power source device, the astable voltage is as such used as the power source for its constant-voltage circuit, thereby making the power source impedance complicated. Moreover, since the current loop in the conventional device is also large, there are various disadvantageous conditions for applying a large quantity of negative feed-back up to the high frequency range.

As another advantage provided by the present invention, it should be appreciated that both the constant-current circuit and the constant-voltage circuit form two-terminal systems. This arrangement enables to perfectly equalize the power source characteristics on the positive side to that on the negative side in the power source of a positive-negative two-source system as already described.

Since the maximum output current of the constant-voltage power source is equal to the set current of the constant-current circuit in the power source device in accordance with the present invention, sufficient safety can be ensured without providing a separate over-current protection circuit. This also is a neteworthy advantage of the present invention.

Since the device according to the invention maintains a constant-voltage characteristic even when supplied by the load circuit with a reverse electro motive force, the device is suitable for power source of the load circuit, such as a servo motor, which generates the reverse electro motive force and yet requires a high performance.

Although certain preferred embodiments of the present invention have been so far explained, the present invention is not limited to such embodiments, especially to the particular arrangement shown in FIG. 7.

In fact, various modifications can be made to the arrangement shown in FIG. 7. For example, according to the operational voltage and the set current of the constant-current circuit, the series circuit of the diodes $Z_1$, $Z_2$, $Z_3$ may consist of no less than two diodes, or may be replaced with elements having a constant voltage characteristic, such as zener diodes or varistors. Where the set current of the constant-current circuit is considerably large, the collector of the transistor $Q_2$ may be connected only to the base of the transistor $Q_3$ (in this case, $R_2=\infty$).

Further, in the constant-voltage circuit 30, the reference voltage circuit 38 may consist of the combination of a zener diode and a resistor which is often used in a conventional constant-voltage circuit. In this case, the parallel connection of the capacitor $C_1$ and the resistor $R_3$ is replaced by the zener diode having a suitable zener voltage, and the FET $Q_4$ by the resistor. However, the combination of the FET $Q_4$, the resistor $R_3$ and the capacitor $C_1$ as shown is considered to be superior since by this combination the thermal drift of the output voltage and the output noise can be minimized.

The error amplifier 40 may consist of a high-performance discrete or IC operational amplifier. It has to be noted, however, that performance of such an amplifier has close relation to the characteristics of the constant-voltage circuit.

Where a considerable amount of current is to be supplied to the constant-voltage circuit, the emitter of the transistor $Q_9$ may be connected to the base of the transistor $Q_{10}$ only ($R_9=\infty$). Further, a capacitor having a capacitance of about 5 pF to 50 pF may be connected between the base and the collector of the transistor $Q_9$ in order to obtain a stabilization effect in the high frequency range. In this case, the capacitance of this capacitor has to be determined such that the output impedance characteristic is not deteriorated.

What is claimed is:

1. An audio device including: at least one active circuit to be driven at a constant voltage and provided with a signal path for passing an audio signal whose highest frequency is higher than the maximum audible frequency, the current necessary for driving the active circuit being dependent on the level of the audio signal; a first constant voltage power source device for said active circuit having a low impedance characteristic and a high noise elimination ratio for a wide frequency range, said constant voltage power source device further comprising:

a pair of input terminals supplied with an unregulated D.C. input voltage derived from an A.C. power source;

a pair of output terminals connected to the active circuit;

a power supply line for connecting one of the input terminals to one of the output terminals;

a ground line for connecting the other of the input terminals to the other of the output terminals;

a constant-current circuit provided in the power supply line for providing a constant output current; and a constant voltage circuit connected between the power supply line and the ground line in parallel with the active circuit and having the single input terminal coupled to the power supply line;

the constant output current of the constant-current circuit being greater than the maximum current necessary for driving the active circuit;

the constant-voltage circuit (i) increasing the current flowing therethrough as the current necessary for driving the active circuit decreases, and (ii) decreasing the current flowing therethrough as the current necessary for driving the active circuit increases, whereby a highly stable output voltage is applied to the active circuit.

2. The device as defined in claim 1, wherein the constant-current circuit comprises means for generating a reference voltage, a resistor for generating a voltage to be compared with the reference voltage, and means for comparing the voltage generated by the resistor with the reference voltage to thereby generate a constant-current as an output of the constant-current circuit; said reference voltage generating means including a first unit having a constant-voltage characteristic, and a second unit for supplying the first unit with a current; said comparing means including first and second transistors, the emitter of the first transistor being connected to one end of the resistor and to the collector of the second transistor, the base of the first transistor being connected to the end of the first unit which is connected to the second unit, the collector of the first transistor being connected to the base of the second transistor, and the emitter of the second transistor being connected to the output terminal of the constant-current circuit.

3. The device as defined in claim 1, wherein the constant-voltage circuit comprises an error amplifier having a pair of differential input terminals and an output terminal, means for generating a reference voltage having an input terminal supplied with the constant output current from the constant current circuit, and an output terminal connected to one of the input terminals of the error amplifier, means for detecting a change of voltage across the output terminals of the constant-voltage circuit and connected to the other of the input terminals of the error amplifier, a control amplifier having an input terminal connected to the output terminal of the error amplifier, the control amplifier controlling current flowing therethrough such that the sum of the current flowing therethrough and the output current of the device equals the output current of the constant-current circuit.

4. The device as defined in claim 3, wherein the means for generating the reference voltage comprises a resistor and an FET having a drain connected to one end of the resistor and to the one of the input terminals of the error amplifier, and a source and a gate both connected to the ground terminal of the constant-voltage circuit, the operating point of the FET being at a Q point where the thermal drift of the drain current of the FET becomes substantially zero.

5. The device as defined in claim 3, wherein an electrolytic capacitor is connected between the output terminals of the constant-voltage circuit to maintain the constant-voltage circuit stable in the high frequency range above approximately 10 KHz.

6. The device as defined in claim 1, further providing at least a second constant-voltage power source device, said first and second devices respectively receiving positive and negative unregulated D.C. input voltages to thereby form at least one pair, the currents of the constant-current circuits of said at least one pair being substantially equal to each other so as to prevent the flow of current through the ground line.

* * * * *